US008600083B2

(12) United States Patent
Chiang et al.

(10) Patent No.: US 8,600,083 B2
(45) Date of Patent: Dec. 3, 2013

(54) ELECTROSTATIC SPEAKER AND MANUFACTURING METHOD THEREOF AND CONDUCTIVE BACKPLATE OF THE SPEAKER

(75) Inventors: Dar-ming Chiang, Hsinchu (TW); Jen-luan Chen, Hsinchu (TW); I-hui Lin, Hsinchu (TW)

(73) Assignee: Taiwan Electrets Electronics Co., Ltd., Hsinchu (TW)

( * ) Notice: Subject to any disclaimer, the term of this patent is extended or adjusted under 35 U.S.C. 154(b) by 335 days.

(21) Appl. No.: 12/960,452

(22) Filed: Dec. 3, 2010

(65) Prior Publication Data

US 2012/0014543 A1 Jan. 19, 2012

(30) Foreign Application Priority Data

Jul. 15, 2010 (TW) ..... 99123362 A

(51) Int. Cl.
*H04R 25/00* (2006.01)

(52) U.S. Cl.
USPC ..... 381/191; 381/174; 381/175

(58) Field of Classification Search
USPC ..... 381/190–191, 173–175, 178, 431
See application file for complete search history.

(56) References Cited

U.S. PATENT DOCUMENTS

| | | | | |
|---|---|---|---|---|
| 3,646,280 | A * | 2/1972 | Tamura et al. | 381/191 |
| 4,160,881 | A * | 7/1979 | Smulders | 310/357 |
| 5,335,286 | A * | 8/1994 | Carlson et al. | 381/191 |
| 5,388,163 | A * | 2/1995 | Elko et al. | 381/191 |
| 6,175,636 | B1 * | 1/2001 | Norris et al. | 381/398 |
| 6,393,129 | B1 * | 5/2002 | Conrad et al. | 381/191 |
| 2001/0046014 | A1 * | 11/2001 | Ohtake et al. | 349/114 |
| 2005/0281419 | A1 * | 12/2005 | Miyazaki et al. | 381/191 |
| 2009/0016552 | A1 * | 1/2009 | Medley et al. | 381/191 |
| 2010/0158284 | A1 * | 6/2010 | Lin et al. | 381/191 |

* cited by examiner

*Primary Examiner* — Suhan Ni
(74) *Attorney, Agent, or Firm* — Cheng-Ju Chiang

(57) ABSTRACT

An electrostatic speaker and a method for manufacturing the speaker are disclosed. Said speaker comprises a vibrating film; an electrode portion disposed on a surface of the vibrating film and joined with the vibrating film; and a conductive backplate spaced from the electrode portion by a distance, the conductive backplate forming a plurality of holes, the vibrating film being deformed and vibrated to generate and release a sound through the holes due to a variation of an electric field generated between the conductive backplate and the electrode portion, wherein the conductive backplate is covered by a polymer layer serving as a protective film. The covering polymer layer on the conductive backplate is capable of improving the stability of the electrostatic speaker and increasing its lifespan.

19 Claims, 5 Drawing Sheets

| Sound Pressure Level (SPL) Varied With Time In Embodiment 1 | | | |
|---|---|---|---|
| Day | SPL | Day | SPL |
| 0 | 80.0 | 91 | 81.4 |
| 3 | 80.0 | 98 | 80.5 |
| 8 | 81 | 105 | 81.5 |
| 15 | 82.8 | 120 | 82.3 |
| 21 | 81.4 | 127 | 80.7 |
| 29 | 81.2 | 133 | 81.3 |
| 35 | 81.7 | 149 | 82.4 |
| 43 | 81.5 | 170 | 80.7 |
| 50 | 81.9 | 184 | 81.0 |
| 57 | 81.4 | 190 | 80.6 |
| 80 | 82.3 | | |

FIG. 3

| Sound Pressure Level (SPL) Varied With Time In Embodiment 4 | | | |
|---|---|---|---|
| Day | SPL(1kHz) | Day | SPL(1kHz) |
| 0 | 87.0 | 92 | 85.9 |
| 7 | 87.3 | 99 | 86.9 |
| 15 | 88.0 | 105 | 87.1 |
| 22 | 87.5 | 121 | 87.4 |
| 29 | 87.8 | 134 | 87.2 |
| 53 | 87.9 | 142 | 87.5 |
| 63 | 86.5 | 156 | 87.0 |
| 70 | 87.5 | 162 | 87.2 |
| 77 | 87.1 | | |

FIG. 4

ELECTROSTATIC SPEAKER AND MANUFACTURING METHOD THEREOF AND CONDUCTIVE BACKPLATE OF THE SPEAKER

TECHNICAL FIELD OF THE INVENTION

The present invention relates to a sound generating device, and more particularly, to an electrostatic speaker and a manufacturing method thereof.

BACKGROUND OF THE INVENTION

A speaker is a transducer that converts electrical energy into sound power for vibrating a film to generate a sound according to an electrical signal. According to driving manners of different speakers, the speakers can be classified into dynamic, piezoelectric, and electrostatic types of speakers.

Nowadays the dynamic speakers have been widely used and applied to products such as televisions, stereograms, microphones, and mobile phones. However, the dynamic speakers are limited by their inherent structures and electrical energy designs. They can not serve the needs of human beings in pursuance of portable and low-current electrical products. The piezoelectric speaker utilizes a piezoelectric effect to deform a piezoelectric material to drive a diaphragm for releasing a sound. However, the resonant frequency of the piezoelectric material is high. Therefore, the piezoelectric speaker is merely applied to an alarm buzzer for now.

The operational principle of the electrostatic speaker is described as follows. A conductive vibrating film is disposed between two fixed electrode plates to form a condenser. A DC bias voltage is applied to the vibrating film and AC voltages of opposite phases are applied to the two electrode plates. The electrostatic force generated by positive and negative charges therebetween drives the vibrating film to vibrate to generate and release sound. A conventional electrostatic speaker requires an amplifier to supply a high DC bias voltage (1,500V-2,000V). However, the conventional electrostatic speaker is expensive and may not be suitable for portable products.

Electret speakers are newly developed, and they are a type of electrostatic speaker. The electret speaker has a flexible characteristic, so it is often referred to as a flexible speaker. The electret speaker has advantages of light weight and small in size, high efficiency, high bandwidth, and low distortion. Considering the size and efficiency, the electret speaker has a greater potential for portable products.

However, the conventional electrostatic speaker and the electret speaker still have many problems to overcome. For example, electrostatic charges may run off since the vibrating film may touch the conductive backplate during a vibrating period or a non-vibrating period of the vibrating film. For this reason, the lifespan of the speaker is decreased. If the stability problem of the electrostatic speaker is not solved, its application in use will be significantly limited.

U.S. Pat. No. 3,646,280 discloses an electrostatic speaker utilizing a conductive fiber for serving as an electrode. Since the conductive fiber directly touches an electrostatic vibrating film (or an electret film), electrostatic charges of the vibrating film may easily run off. US Patent Publication Serial No. 20090016552 discloses an electrostatic speaker utilizing a porous conductive layer for serving as an electrode. The electrode is unprotected so the lifespan of an electrostatic film will be decreased.

Taiwan Patent Serial No. I293233 discloses an electret speaker utilizing a flexible conductive plate or a metal mesh for serving as an electrode. The electrode may contact a vibrating film so electret charges of the vibrating film may easily run off. Taiwan Patent Serial No. I294250 discloses an electret actuator utilizing a conductive plate forming a plurality of holes or apertures for serving as an electrode. The electrode is unprotected so the lifespan of the electret actuator will be decreased.

Therefore, how to improve the stability of an electrostatic speaker and increase the lifespan of the speaker is an important issue in this technical field.

SUMMARY OF THE INVENTION

The main objective of the present invention is to provide an electrostatic speaker and manufacturing method thereof, for improving the stability of the electrostatic speaker and increasing its lifespan.

According to the above objective, the present invention provides an electrostatic speaker, comprising: a vibrating film; an electrode portion disposed on a surface of the vibrating film and joined with the vibrating film; and a conductive backplate spaced from the electrode portion by a distance, the conductive backplate forming a plurality of holes, the vibrating film being deformed and vibrated to generate and release sound through the holes due to a variation of an electric field generated between the conductive backplate and the electrode portion, wherein the conductive backplate is covered by a polymer layer serving as a protective film.

In another aspect, the present invention provides an electrostatic speaker, comprising: a first vibrating film and a second vibrating film; an electrode portion joined with the first vibrating film and the second vibrating film; and a first conductive backplate and a second conductive backplate, disposed at opposite sides of the electrode portion and respectively spaced from the electrode portion by a distance, each of the two conductive backplates forming a plurality of holes, the first vibrating film and the second vibrating film being deformed and vibrated to generate and release sound through the holes due to a variation of an electric field generated between the electrode portion and the two conductive backplates, wherein each of the two conductive backplates is covered by a polymer layer serving as a protective film.

In still another aspect, the present invention provides an electrostatic speaker manufacturing method, comprising steps of: providing a vibrating film; disposing an electrode portion on a surface of the vibrating film and joining the electrode portion with the vibrating film; disposing a conductive backplate at a distance from the electrode portion, the conductive backplate forming a plurality of holes, the vibrating film being deformed and vibrated to generate and release sound through the holes due to a variation of an electric field generated between the conductive backplate and the electrode portion; and covering the conductive backplate with a polymer layer serving as a protective film.

In the present invention, since the conductive backplate is covered by a polymer layer serving as a protective film, this protective film can prevent the electrostatic vibrating film from directly contacting with conductive parts of the backplate and thereby is able to avoid the electrostatic charges of the vibrating film running off during a vibrating period or a non-vibrating period of the vibrating film. Therefore, the lifespan of the electrostatic speaker is increased in the present invention.

BRIEF DESCRIPTION OF THE DRAWINGS

The present invention will be described in details in conjunction with the appending drawings.

FIG. 3 is a diagram showing the sound pressure level (SPL) varied with time at 1 kHz frequency for a 10×14 $cm^2$ thin speaker in Embodiment 1 according to the present invention.

FIG. 4 is a diagram showing the sound pressure level varied with time at 1 kHz frequency for a 10×14 $cm^2$ thin speaker in Embodiment 4 according to the present invention.

DETAILED DESCRIPTION OF THE INVENTION

Figure 1:
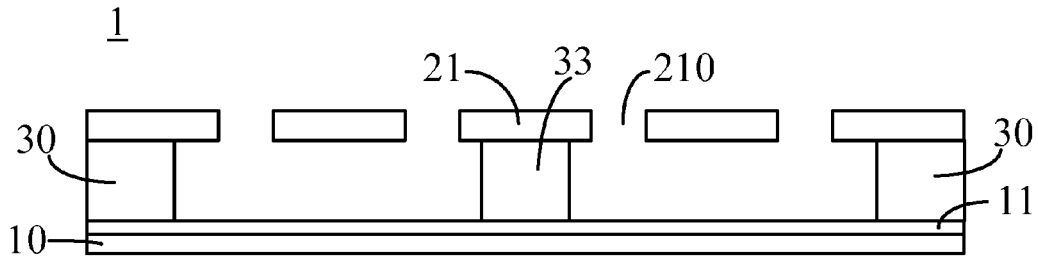
FIG. 1 is a schematic structure diagram showing an electrostatic speaker according to the present invention.

With reference to the drawings and in particular to FIG. 1, which is a schematic structure diagram showing an electrostatic speaker constructed in accordance with the present invention, generally designated at 1, the electrostatic speaker 1 comprises an electrode portion 10, a first vibrating film 11, a first conductive backplate 21, spacers 33, and encapsulating materials 30.

As shown in FIG. 1, the electrode portion 10 is disposed on a surface of the first vibrating film 11. The electrode portion 10 and the first vibrating film 11 are joined together. The first vibrating film 11 can be implemented as an electret film. In addition, the first conductive backplate 21 is spaced from the electrode portion 10 by a distance. The first vibrating film 11 is located between the electrode portion 10 and the first conductive backplate 21. In addition, a gap is formed between the electrode portion 10 and the first conductive backplate 21. The electrode portion 10 and the first conductive backplate 21 are set substantially parallel to each other. Therefore, the electric charges of the first vibrating film 11 can be shielded effectively.

The spacers 33 are arranged between the electrode portion 10 and the first conductive backplate 21. The electrode portion 10 and the first conductive backplate 21 are sealed up at their peripheral regions by using the encapsulating materials 30. The first conductive backplate 21 forms a plurality of first holes 210 for releasing a sound. When an electric field is applied between the electrode portion 10 and the first conductive backplate 21, the first vibrating film 11 is deformed and vibrated so as to generate a sound due to a variation of the electric field. Then, the sound is released through the first holes 210.

The first conductive backplate 21 is covered by a polymer layer serving as a protective film. Thus, the first conductive backplate 21 is a conductive backplate coated with a polymer. The polymer-coated conductive backplate 21 still maintains the first holes 210 and the first holes 210 are not filled up. Therefore, it would not be affected to release the sound generated by the first vibrating film 11.

Figure 2:
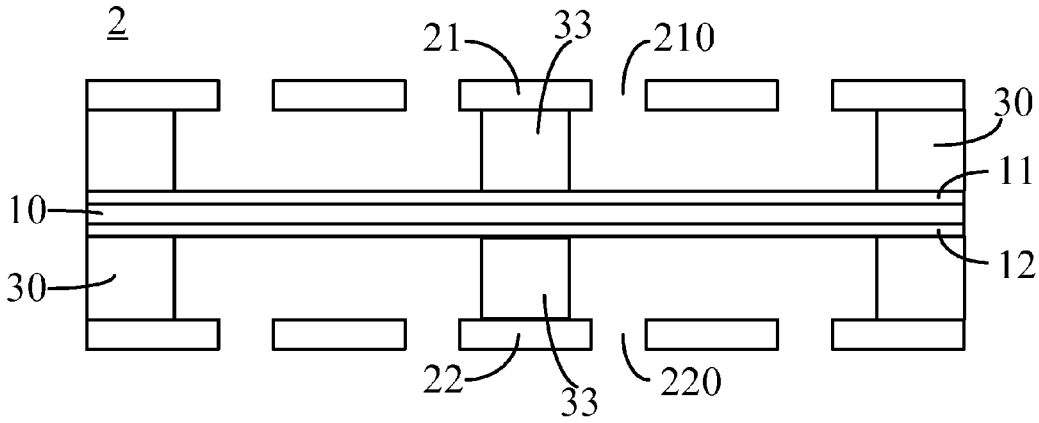
FIG. 2 is a schematic structure diagram showing a double-structural electrostatic speaker according to the present invention.

FIG. 2 is a schematic structure diagram showing a double-structural electrostatic speaker 2 according to the present invention. Each structural layer of the double-structural electrostatic speaker 2 shown in FIG. 2 is similar to or the same as the electrostatic speaker 1 shown in FIG. 1. The double-structural electrostatic speaker 2 comprises an electrode portion 10, a first vibrating film 11, a second vibrating film 12, a first conductive backplate 21, a second conductive backplate 22, spacers 33, and encapsulating materials 30.

As shown in FIG. 2, the electrode portion 10 is joined to the first vibrating film 11 and the second vibrating film 12. Both of the first vibrating film 11 and the second vibrating film 12 can be implemented as electret films. The first conductive backplate 21 and the second conductive backplate 22 are disposed at opposite sides of the electrode portion 10 and are respectively spaced from the electrode portion 10 by a distance. Gaps are respectively formed between the electrode portion 10 and the two conductive backplates 21, 22. The first vibrating film 11 is located between the electrode portion 10 and the first conductive backplate 21, while the second vibrating film 12 is located between the electrode portion 10 and the second conductive backplate 22.

The first conductive backplate 21 forms a plurality of first holes 210 and the second conductive backplate 22 forms a plurality of second holes 220. When electric fields are applied between the electrode portion 10 and the two conductive backplates 21, 22, the first vibrating film 11 and the second vibrating film 12 are deformed and vibrated so as to generate a sound due to variations among the electric fields. Then, the sound is released through the first holes 210 and the second holes 220.

The electric field applied between the electrode portion 10 and the first conductive backplate 21 can be opposite to the electric field between the electrode portion 10 and the second conductive backplate 22 so as to generate a push-pull effect for driving the first vibrating film 11 and the second vibrating film 12 to vibrate, and thereby generating a sound.

As shown in the electrostatic speaker 2 of FIG. 2, the electrode portion 10 is a single electrode disposed between the first vibrating film 11 and the second vibrating film 12. However, the present invention is not limited to this implementation. Two separated electrode portions respectively disposed on the surfaces of the first vibrating film 11 and the second vibrating film 12 can be implemented as well.

Each of the first conductive backplate 21 and the second conductive backplate 22 is covered by a polymer layer serving as a protective film. Thus, the two conductive backplates 21, 22 are conductive backplates coated with polymer layers. The polymer-coated conductive backplates 21, 22 still maintain the first holes 210 and the second holes 220 respectively, and the holes 210, 220 are not filled up. Therefore, it would not be affected to release the sound generated by the vibrating films 11, 12.

Conventionally, electrostatic charges may run off since the vibrating film may touch the conductive backplate during vibration. However, in the present invention, since the conductive backplate is covered by a polymer layer, which serves as a protective film, this protective film can prevent the electrostatic vibrating film from directly contacting with conductive parts of the backplate, thereby avoiding the electrostatic charges of the vibrating film running off during a vibrating period or a non-vibrating period of the vibrating film. Therefore, the lifespan of the electrostatic speaker is increased in the present invention.

The afore-mentioned polymer layer can be a thermosetting polymer or a thermoplastic polymer. The polymer layer may contain elements, such as oxygen, nitrogen, silicon, sulfur, phosphor, halogen, or contain a compound having an unsaturated bond. The polymer layer also can be implemented as a foam polymer or a porous polymer. In addition, the polymer layer may be an aliphatic polymer, an aromatic polymer, or a polymer having an aromatic ring, or their mixtures.

The polymer layer can be in a form of coating, wax, or adhesive. The coating, the wax, or the adhesive may include an additive agent. The additive agent can be an antioxidant, a colorant, an UV absorber, a fire retardant, a fungicide, a silicon oil, an antimicrobial, a dispersant, an anti-foam agent, a coupling agent, a leveling agent, a plasticizer, an anti-sagging agent, a lubricating agent, a thickener, or an inorganic filler. In addition, the polymer layer can be a rubber, a polyurethane (PU), an acrylic resin, a polyvinyl alcohol (PVA), an epoxy resin, a thermoplastic elastomer (TPE), or a synthetic resin, or their mixtures. Besides, the polymer layer can be a polymer of a solvent type or a water type.

The covering polymer layers of the first conductive backplate 21 and the second conductive backplate 22 should not block the holes 210, 220 of the conductive backplates 21, 22 or the sound pressure would be affected. Whether or not those holes 210, 220 are blocked can be determined by measuring and comparing the sound pressures of speakers made of those conductive backplates with the covering polymer layer and without the covering polymer layer. Generally, a suitable thickness of the covering polymer layer is approximately between 0 and 200 micrometers. In the present invention, a thickness of the covering polymer layer is preferred to be set between 0.01 and 20 micrometers. In addition, the covering polymer layer can be a multi-layer structure and each layer can be made of a polymeric material.

The first conductive backplate 21 or the second conductive backplate 22 can be implemented as an electrode mesh, such as a metal mesh, a metal-coated plastic mesh, a metal-coated rubber mesh, and a plate having conductive nanotubes, and the likes. The mesh also can be a composite mesh or a mix-woven mesh manufactured therefrom. According to industrial standards, the size of holes on a mesh generally depends on the total number of holes of the mesh. Typically, the number of holes for one mesh is between 20 and 2000. These holes are utilized for releasing the sound and the sound pressure and quality would be affected by the total number of holes of the mesh. In the present invention, the total number of holes for one mesh is preferred to be set between 20 and 2,000 for acquiring a suitable sound pressure and a better quality. In addition, the holes 210, 220 of the first conductive backplate 21 and the second conductive backplate 22 may have different sizes of aperture.

The first vibrating film 11 or the second vibrating film 12 can be implemented as an electret film. The electret film is a thin film capable of retaining static charges for a long time and is manufactured by an electrized dielectric material. In addition, the first vibrating film 11 or the second vibrating film 12 can be a vibrating film manufactured from a dielectric material of a single-layer structure or a multi-layer structure. The dielectric material can be fluorinated ethylene propylene (FEP), polytetrafluoroethylene (PTFE), polyvinylidene fluoride (PVDF), or partial fluorinated polymer, or other applicable materials.

The electrode portion 10 can be implemented as a conductive layer, such as a conductive metal film, a silver paste, and an indium tin oxide (ITO) film, and the likes. However, the present invention is not limited to these implementations. The electrode portion 10 also can be a conductor of which a surface is covered by an insulating material or coated with other conductive materials.

The first conductive backplate 21 or the second conductive backplate 22 can be constructed by a flexible conductive plate having openings (or holes) and spacers disposed thereon. The two conductive backplates 21, 22 in combination with the electrode portion 10, the first vibrating film 11, and the second vibrating film 12 can form a flexible structure, and thereby form a flexible speaker.

Figure 6:
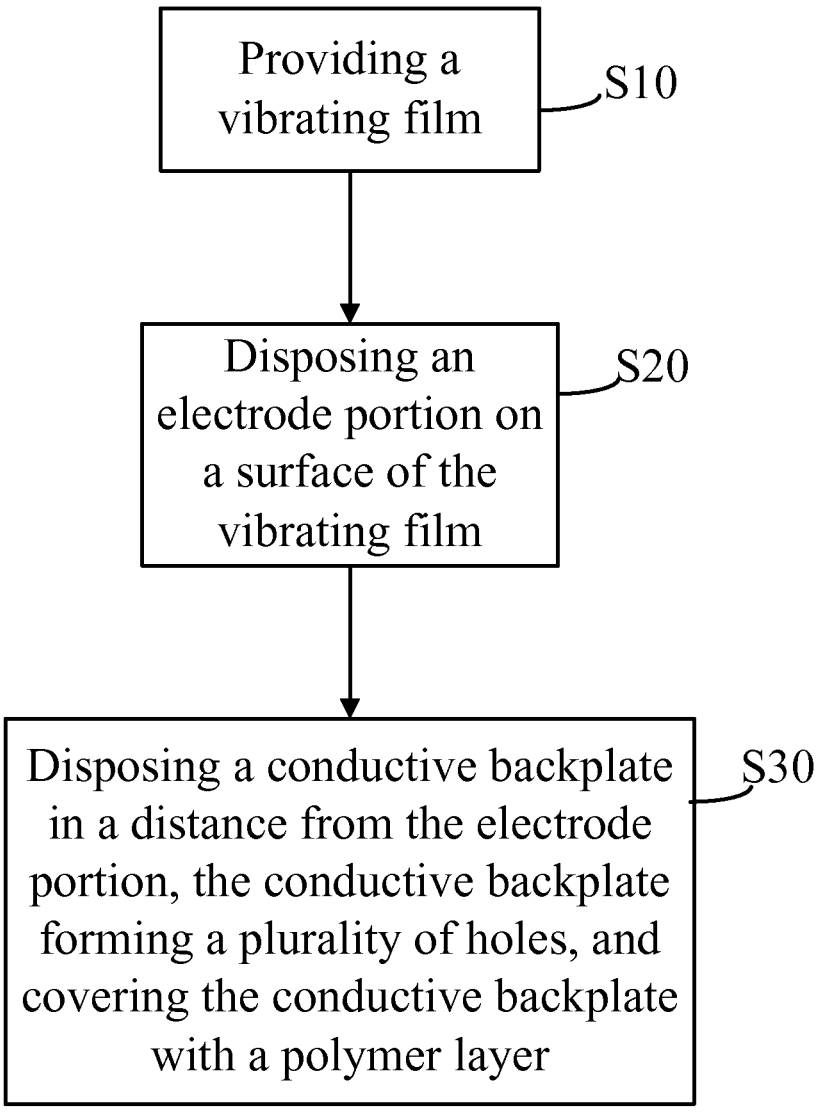
FIG. 6 is a flow chart showing an electrostatic speaker manufacturing method according to the present invention.

FIG. 6 is a flow chart showing an electrostatic speaker manufacturing method according to the present invention. In the beginning, a vibrating film is provided (Step S10). The vibrating film can be an electret film. Next, an electrode portion is disposed on a surface of the vibrating film. The electrode portion and the vibrating film are joined together (Step S20). Next, a conductive backplate is disposed in a distance from the electrode portion. The conductive backplate has a plurality of holes. The conductive backplate is covered by a polymer layer. The polymer layer can be utilized for protecting the conductive backplate (Step S30). A variation of an electric field between the conductive backplate and the electrode portion makes the vibrating film being deformed and vibrated to generate sound. Then, the sound is released through the holes.

The covering polymer layer of the conductive backplate can be formed by the following manners: (1) by immersing the conductive backplate in a liquid containing a polymeric material and drying the conductive backplate drawn out from the liquid; (2) by immersing the conductive backplate in a liquid containing unsaturated monomers and crosslinking the unsaturated monomers by heat, light, radiation, or wet gas; (3) by of polymeric molecules on the conductive backplate; (4) by utilizing a spray coating or a powder coating to coat a polymer material on the conductive backplate; (5) by manufacturing a film with a polymer and adhering the film to the conductive backplate.

In order to increase the adhesion between the polymer layer and the conductive backplate, the conductive backplate can be undercoated with a primer before immersing the conductive backplate in a liquid containing a polymeric material or immersing with reactive monomers. In the manners of immersing the conductive backplate in an organic polymeric liquid, immersing with a liquid containing unsaturated monomers and then crosslinking said monomers, and in the manner of evaporation deposition, the concentration of said liquid or the amount of the monomers must be controlled precisely so that the gap between the vibrating film and the polymer-coated conductive backplate would not be filled up to affect the sound pressure of the speaker.

The embodiments implemented according to the electrostatic speaker and the manufacturing method of the present invention are described as follows.

Embodiment 1

An amount of 50 grams of Taipol TPE SBS-4202 (a copolymer of 60% butadiene (or isoprene) and 40% styrene, available from TSRC Corporation) and an amount of 5 grams of fluorinated cycloalkene (fabricated or synthesized according to U.S. patent application Ser. No. 11/776,554 or UK Patent Application Serial No. GB 0,721,860) are placed into a conical flask of two liters capacity and then 1,200 ml of methylbenzene is added thereto. These polymeric reactants are stirred mechanically until the powder is completely dissolved at a temperature of 70° C. After filtering by a strainer with 0.5μ openings, a mixed solution is fabricated. Next, a stainless steel conductive backplate (150 meshes or openings) is immersed in the aforesaid solution at room temperature for a few minutes. After drying the conductive backplate drawn out from the solution, at a temperature of 70° C., a protective film is formed thereon. A multimeter or avometer is utilized to measure the conductivity of the protected conductive backplate and an unprotected conductive backplate. No conductivity difference is resident between the two backplates. For example, the resistance between any two points of the same conductive backplate is smaller than 15 Ω.

The optical microscope spectra of the protected conductive backplate and the unprotected conductive backplate shows that the holes or openings of the polymer-protected conductive backplate are not blocked so that the sound pressure of the electret speaker would not be affected. In addition, a 10×14 $cm^2$ thin speaker (1.5 mm of total thickness) is manufactured with the polymer-protected conductive backplate according to Taiwan Patent Serial No. I293233. The sound pressure performance and the quality of aforesaid speaker are essentially the same as those of a speaker manufactured with an unprotected conductive backplate. However, the lifespan of the speaker manufactured with the polymer-protected conductive backplate is increased extremely. The sound pressure is measured by utilizing the following instruments: (1) IEA EA-1 Electro-Acoustic Analyzer/CLIO (20 Hz-100 kHz); (2) GRAS 40AC ½" Free-Field Microphone (3.15 Hz-40 kHz); (3) Preamplifier for B&K 2670 (20 Hz-100 kHz). The measuring temperature is 20-27° C. and the relative humidity is 55-65%. FIG. 3 is a diagram showing the sound pressure level (SPL) varied with time at 1 kHz frequency for the 10×14 $cm^2$ thin speaker. According to the data shown in FIG. 3, the sound pressure of the speaker manufactured with the polymer-protected conductive backplate is still maintained approximately at 80 dB after 180 days. In the control group, the sound pressure of the speaker manufactured with the unprotected conductive backplate has decreased to 71 dB after 180 days.

Embodiment 2

An amount of 50 grams of Taipol TPE SBS-4202 and an amount of 5 grams of fluorinated cycloalkene (fabricated or synthesized according to U.S. patent application Ser. No. 11/776,554 or UK Patent Application Serial No. GB 0,721, 860) are dissolved in 300 ml of methylbenzene. Then, a spray coating is utilized for spraying the aforesaid solution on an aluminum-coated plastic conductive backplate (spraying on the aluminum surface). After drying, a 10×14 $cm^2$ thin speaker is manufactured as described in Embodiment 1. The sound pressure performance and the quality of aforesaid speaker are essentially the same as those of a speaker manufactured with an unprotected conductive backplate. That is, the conductive backplate processed to be coated with a protective film would not affect the sound pressure performance. The sound pressure of the speaker manufactured with the polymer-protected conductive backplate is still maintained approximately at 83 dB after 180 days. In the control group, the sound pressure of the speaker manufactured with the unprotected conductive backplate has decreased to 72 dB after 180 days.

Embodiment 3

A fluorinated coating, Lumiflon LF200 (Tg: 35° C.; OH value: 52 mg KOH/g-polymer; specific gravity: 1.12) available from Asahi Corporation is mixed with a crosslinking agent of unsaturated monomers containing isocyanate. Then, a spray coating is utilized for spraying the aforesaid solution on a stainless steel conductive backplate (60 meshes or openings). After drawing out the conductive backplate from the solution and drying it for three hours at a temperature of 80° C., a protective film is formed thereon. Next, a 10×14 $cm^2$ thin speaker is manufactured as described in Embodiment 1. The sound pressure performance and the quality of aforesaid speaker are essentially the same as those of a speaker manufactured with an unprotected conductive backplate. However, the lifespan of the speaker manufactured with the polymer-protected conductive backplate is increased extremely.

Embodiment 4

Figure 5:
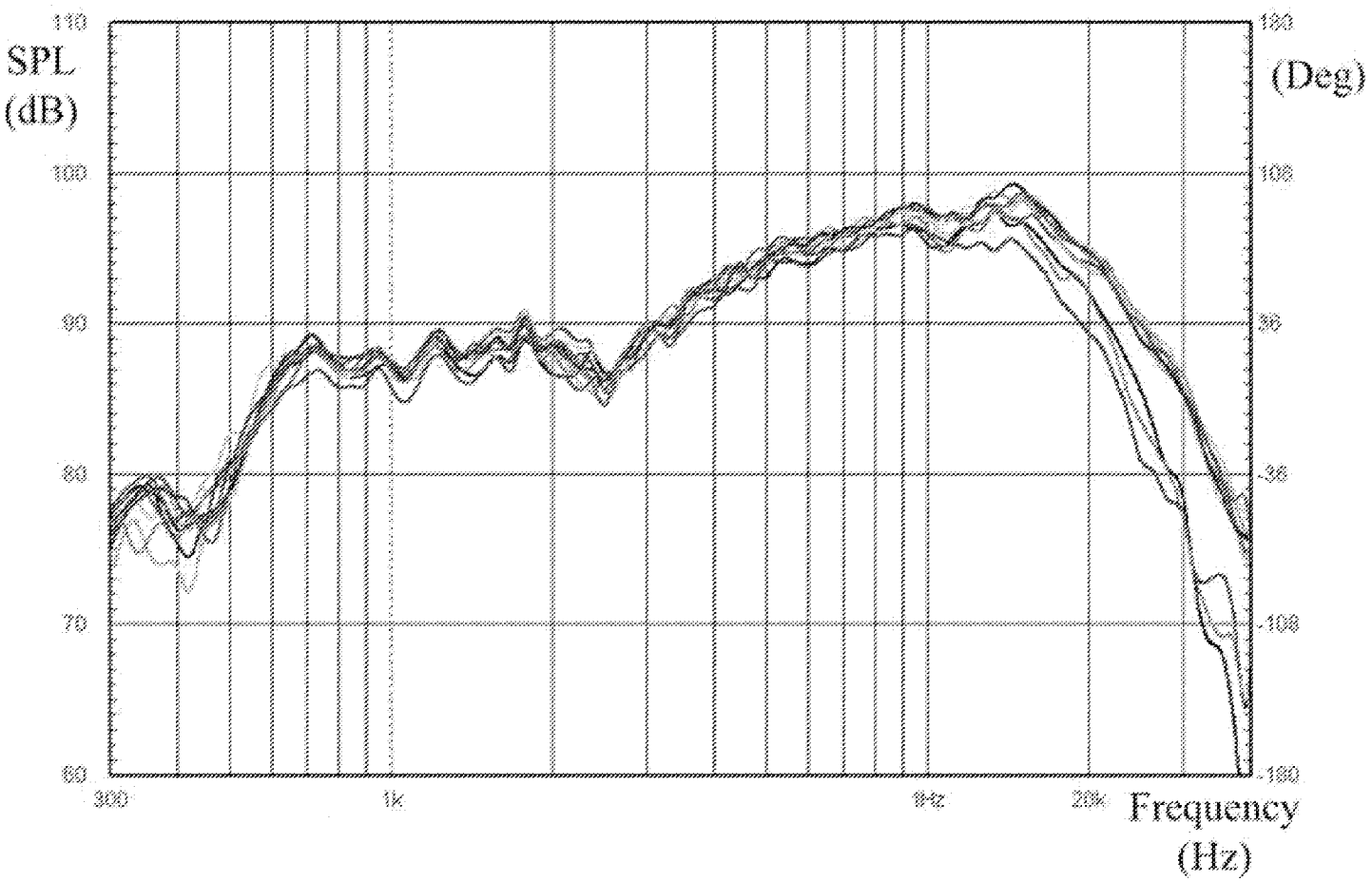
FIG. 5 is a diagram showing the variation of sound pressure level with respect to different frequencies for a 10×14 $cm^2$ thin speaker according to Embodiment 4 of the present invention.

An amount of 50 grams of ethylene vinyl acetate (14% vinyl acetate; melting point: 75° C.; density: 0.948 g/mL at 25° C.) is placed into a conical flask of two liters capacity and then 1,200 ml of methylbenzene is added thereto. The reactant is stirred mechanically until the powder is completely dissolved at a temperature of 70° C. After filtering by a strainer with 0.5μ openings, a mixed solution is fabricated. Next, a stainless steel conductive backplate (150 meshes or openings) is immersed in the aforesaid solution at room temperature for a few minutes. After drying the conductive backplate drawn out from the solution, at a temperature of 70° C., a protective film is formed thereon. A multimeter or avometer is utilized to measure the conductivity of the protected conductive backplate and an unprotected conductive backplate. No conductivity difference is resident between the two backplates. For example, the resistance between any two points of the same conductive backplate is smaller than 15Ω. Next, a 10×14 $cm^2$ thin speaker is manufactured as described in Embodiment 1. The sound pressure performance and the quality of aforesaid speaker are essentially the same as those of a speaker manufactured with an unprotected conductive backplate. That is, the conductive backplate processed to be coated with a protective film would not affect the sound pressure performance. Referring to FIGS. 4 and 5, the sound pressure of the speaker manufactured with the polymer-protected conductive backplate is still maintained approximately at 87 dB after 162 days. In the control group, the sound pressure of the speaker manufactured with the unprotected conductive backplate has decreased to 75 dB after 162 days.

Embodiment 5

A spray coating is utilized to spray 50 grams of Berlin Emercote A-581 (an aqueous-based epoxy resin; two components; proportional ratio of main agent to curing agent=15:1; viscosity: 70 KU) on a stainless steel conductive backplate (60 meshes or openings) at a pressure of 5 $Kg/cm^2$. After drying the conductive backplate for three hours at a temperature of 60° C., a protective film is formed thereon. Next, a 10×14 $cm^2$ thin speaker is manufactured as described in Embodiment 1. The sound pressure performance and the quality of aforesaid speaker are essentially the same as those of a speaker manufactured with an unprotected conductive backplate. That is, the conductive backplate processed to be coated with a protective film would not affect the sound pressure performance. The sound pressure of the speaker manufactured with the polymer-protected conductive backplate is still maintained approximately at 85 dB after 150 days. In the control group, the sound pressure of the speaker manufactured with the unprotected conductive backplate has decreased to 75 dB after 150 days.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. An electrostatic speaker, comprising:

a vibrating film;

an electrode portion disposed on a surface of the vibrating film and joined with the vibrating film; and a conductive backplate spaced a distance from the electrode portion, the conductive backplate forming a plurality of holes, the vibrating film being deformed and vibrated to generate and release sound through the holes due to a variation of an electric field generated between the conductive backplate and the electrode portion, wherein the conductive backplate is covered by a polymer layer serving as a protective film.

2. The electrostatic speaker of claim 1, wherein the vibrating film is an electret film.

3. The electrostatic speaker of claim 1, wherein the polymer layer is selected from a group consisting of a thermosetting polymer and a thermoplastic polymer.

4. The electrostatic speaker of claim 1, wherein the polymer layer contains elements selected from a group consisting of oxygen, nitrogen, silicon, sulfur, phosphor, and halogen.

5. The electrostatic speaker of claim 1, wherein the polymer layer comprises a compound having an unsaturated bond.

6. The electrostatic speaker of claim 1, wherein the polymer layer is selected from a group consisting of a foam polymer and a porous polymer.

7. The electrostatic speaker of claim 1, wherein the polymer layer is selected from a group consisting of an aliphatic polymer, an aromatic polymer, a polymer having an aromatic ring, and their mixtures.

8. The electrostatic speaker of claim 1, wherein the polymer layer is in a form selected from a group consisting of coating, wax, and adhesive.

9. The electrostatic speaker of claim 8, wherein at least one of the coating, the wax, and the adhesive comprises an additive agent.

10. The electrostatic speaker of claim 9, wherein the additive agent is selected from a group consisting of an antioxidant, a colorant, an UV absorber, a fire retardant, a fungicide, a silicon oil, an antimicrobial, a dispersant, an anti-foam agent, a coupling agent, a leveling agent, a plasticizer, an anti-sagging agent, a lubricating agent, a thickener, and an inorganic filler.

11. The electrostatic speaker of claim 8, wherein the polymer layer is a polymer selected from a group consisting of a rubber, a polyurethane (PU), an acrylic resin, a polyvinyl alcohol (PVA), an epoxy resin, a thermoplastic elastomer (TPE), a synthetic resin, and their mixtures.

12. The electrostatic speaker of claim 8, wherein the polymer layer is a polymer selected from a group consisting of a solvent type and a water type.

13. The electrostatic speaker of claim 1, wherein the polymer layer is a multi-layer structure and each layer is made of a polymeric material.

14. The electrostatic speaker of claim 1, wherein a thickness of the polymer layer is less than 200 micrometers.

15. The electrostatic speaker of claim 1, wherein the conductive backplate is a mesh selected from a metal mesh, a metal-coated plastic mesh, a metal-coated rubber mesh, a plate having conductive nanotubes, and a composite mesh or a mix-woven mesh manufactured therefrom.

16. The electrostatic speaker of claim 15, wherein a number of holes of the mesh is between 20 and 2000.

17. The electrostatic speaker of claim 1, wherein the holes have different sizes of aperture.

18. An electrostatic speaker, comprising:

a first vibrating film and a second vibrating film;

an electrode portion joined with the first vibrating film and the second vibrating film; and a first conductive backplate and a second conductive backplate, disposed at opposite sides of the electrode portion and respectively spaced from the electrode portion by a distance, each of the two conductive backplates forming a plurality of holes, the first vibrating film and the second vibrating film being deformed and vibrated to generate and release sound through the holes due to a variation of an electric field generated between the electrode portion and the two conductive backplates, wherein each of the two conductive backplates is covered by a polymer layer serving as a protective film.

19. A conductive backplate of an electrostatic speaker, the conductive backplate having a plurality of holes, a sound being released through the holes, wherein the conductive backplate is covered by a polymer layer serving as a protective film.

* * * * *